US007934820B2

(12) United States Patent
Nakamura

(10) Patent No.: US 7,934,820 B2
(45) Date of Patent: May 3, 2011

(54) INK CARTRIDGE AND INK FILLING METHOD THEREFOR

(75) Inventor: Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 516 days.

(21) Appl. No.: 12/038,775

(22) Filed: Feb. 27, 2008

(65) Prior Publication Data

US 2008/0204487 A1 Aug. 28, 2008

(30) Foreign Application Priority Data

Feb. 28, 2007 (JP) ..... 2007-050354

(51) Int. Cl.
*B41J 2/175* (2006.01)

(52) U.S. Cl. ..... 347/86

(58) Field of Classification Search ..... 347/84–87
See application file for complete search history.

(56) References Cited

U.S. PATENT DOCUMENTS 7,029,103 B2 * 4/2006 Iida ..... 347/86
7,278,722 B2 10/2007 Sasaki et al.

FOREIGN PATENT DOCUMENTS

JP 2000177142 A 6/2000
JP 2005231220 A 9/2005

* cited by examiner

*Primary Examiner* — An H Do
(74) *Attorney, Agent, or Firm* — Baker Botts L.L.P.

(57) ABSTRACT

An ink cartridge includes an ink storage chamber and an ink supply chamber, and the ink supply chamber includes a check valve configured to selectively open and close a communication hole between the ink storage chamber and the ink supply chamber depending on a pressure differential between a first pressure in the ink storage chamber and a second pressure in the ink supply chamber. When the ink storage chamber is filled with ink, the first pressure is lower than an atmospheric pressure, and the second pressure is higher than the first pressure such that the check valve closes the communicating hole.

10 Claims, 13 Drawing Sheets

INK CARTRIDGE AND INK FILLING METHOD THEREFOR

CROSS-REFERENCE TO RELATED APPLICATIONS

This application is based upon and claims the benefit of priority from Japanese Patent Application No. 2007-050354, filed on Feb. 28, 2007, the entire contents of which are incorporated herein by reference.

TECHNICAL FIELD

The present invention generally relates to an ink cartridge and an ink filling method therefor. In particular, the present invention relates to an ink cartridge with an ink supply chamber configured to allow a fluid communication between an outside of the ink cartridge and an ink storage chamber, and an ink filling method therefor.

BACKGROUND

Among ink ejection devices such as inkjet printers for printing images on a sheet of paper by ejecting ink, some of the ink ejection devices use ink cartridges configured to store ink therein and to be removable mountable to the ink ejection devices. The ink cartridge has an ink storage chamber therein for storing ink. In order to prevent the reduction in quality of ink stored in the ink storage chamber, the ink storage chamber is held under a pressure lower than the atmospheric pressure. Accordingly, air in the ink storage chamber is prevented from being dissolved into the ink, and the ink is prevented from being oxidized. A cartridge, described in JP-A-2000-177142, is packaged, in which a space defined by a spacer member within the cartridge is depressurized. Incidentally, if a pressure is lower than the atmospheric pressure, the pressure sometimes is called, "negative pressure." The expression, negative pressure, may be used in this application.

However, when an ink cartridge with a depressurized ink storage chamber is mounted to an ink ejection device such as an inkjet printer, the negative pressure in the ink storage chamber may propagate to the inside of the ink ejection device. For example, the negative pressure may propagate from the ink storage chamber to the nozzles of an ejection head of the ink ejection device, and the ink within the nozzles is pulled such that menisci of ink formed in the nozzles may be broken, which interferes with subsequent printing operations.

SUMMARY

The present invention is conceived in view of the above circumstances, and an object of the invention is to provide an ink cartridge in which a pressure in an ink storage chamber, which is lower than the atmospheric pressure, does not propagate to the inside of an ink ejection device when the ink cartridge is mounted to the ink ejection device; and an ink filling method thereof.

According to an aspect of the invention, there is provided an ink cartridge comprising: an ink storage chamber configured to store ink therein; an atmospheric communication portion configured to selectively allow fluid communication between the ink storage chamber and an outside of the ink cartridge; and an ink supply portion comprising:

an ink supply chamber configured to communicate with the ink storage chamber via a communication hole formed at a first end of the ink supply chamber, and configured to communicate with the outside of the ink cartridge via an ink supply hole formed at a second end of the ink supply chamber, such that ink stored in the ink storage chamber is supplied to the outside of the ink cartridge via the ink supply chamber; a closing member configured to selectively open and close the ink supply hole; and a check valve configured to selectively open and close the communication hole depending on a pressure differential between a first pressure in the ink storage chamber and a second pressure in the ink supply chamber, wherein, when the ink storage chamber is filled with ink, and the ink supply hole and the atmospheric communication portion are closed, the first pressure is lower than an atmospheric pressure, and the second pressure is higher than the first pressure such that the check valve closes the communication hole.

According to another aspect of the invention, there is provided an ink filling method for an ink cartridge, the ink cartridge comprising: an ink storage chamber configured to store ink therein; at least one atmospheric communication portion configured to selectively allow fluid communication between the ink storage chamber and an outside of the ink cartridge; and an ink supply portion comprising: an ink supply chamber configured to communicate with the ink storage chamber via a communication hole formed at a first end of the ink supply chamber, and configured to communicate with the outside of the ink cartridge via an ink supply hole formed at a second end of the ink supply chamber, such that ink stored in the ink storage chamber is supplied to the outside of the ink cartridge via the ink supply chamber; a closing member configured to selectively open and close the ink supply hole; and a check valve configured to selectively open and close the communication hole depending on a pressure differential between a first pressure in the ink storage chamber and a second pressure in the ink supply chamber, said ink filling method for the ink cartridge comprising: discharging air in the ink storage chamber from the at least one atmospheric communication portion to make the first pressure to be lower than an atmospheric pressure; after said discharging air, injecting ink from the at least one atmospheric communication portion into the ink storage chamber and the ink supply chamber; and after said injecting ink, increasing the second pressure to be higher than the first pressure such that the check valve closes the communication hole.

DESCRIPTION

Illustrative, non-limiting embodiments of the invention will be described with reference to the drawings. Firstly, a first embodiment will be described.

First Embodiment

Figure 1:
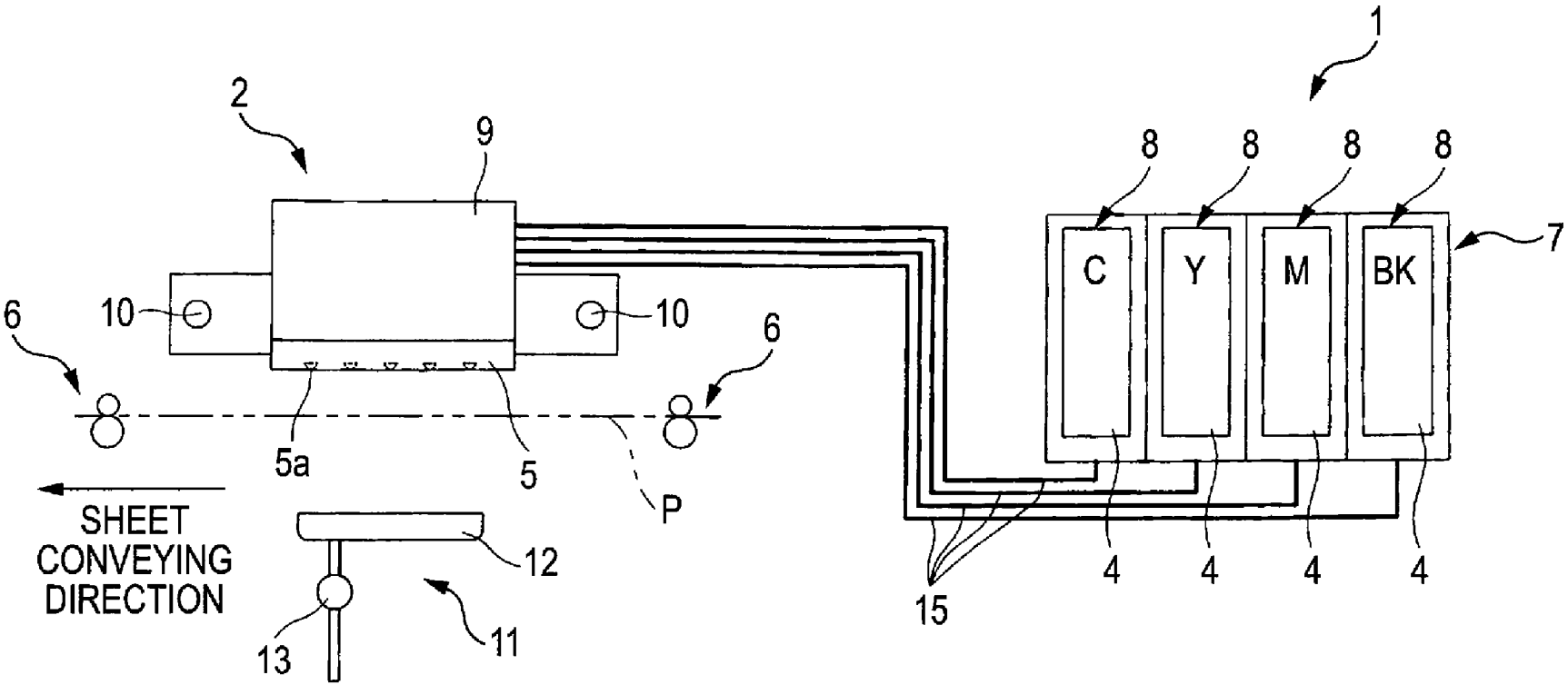
FIG. 1 is a schematic diagram showing an inkjet recording system according to an embodiment of the invention.

As is shown in FIG. 1, an inkjet recording system 1 according to this embodiment includes an inkjet printer 2 configured to record an image by ejecting ink onto a recording sheet of paper P, a control unit 3 configured to control the overall operation of the inkjet printer 2, four ink cartridges 4 storing ink of four colors (cyan (C), yellow (Y), magenta (M) and black (BK)), respectively, which are used in the inkjet printer 2.

The inkjet printer 2 includes an inkjet head 5 having a plurality of nozzles 5*a* for ejecting ink drops downwards, a conveying mechanism 6 configured to convey a recording sheet of paper P in a predetermined sheet conveying direction (from right to left in FIG. 1) below the inkjet head 5, and a holder 7 having four cartridge mounting units 8 into which the four ink cartridges 4 are mounted individually.

The inkjet head 5 is mounted on a carriage 9 capable of reciprocating along two guide shafts 10 that extend in a direction perpendicular to the surface of the sheet of FIG. 1. Ink flow paths (not shown) are formed inside the inkjet head 5 to communicate respectively with the nozzles 5*a*. In addition, the ink cartridges 4 which store ink of the four colors individually are removably mounted, respectively, into the four cartridge units 8 of the holder 7 in a predetermined mounting direction, which is perpendicular to the surface of the sheet of FIG. 1. An ink extraction pipe 163 (described later) is provided at a predetermined position in each of the cartridge mounting units 8 so that the ink extraction pipe 163 is inserted into an ink supply hole of the ink cartridge 4 when the ink cartridge 4 is mounted to a corresponding one of the cartridge mounting units 8. Furthermore, the inkjet head 5 and the four cartridge mounting units 8 of the holder 7 are connected to each other via four tubes 15. When the four ink cartridges 4 are respectively mounted in the four cartridge mounting units 8, the ink of four colors respectively stored in the four ink cartridges 4 is supplied to the corresponding ink flow paths within the inkjet head 5 via the ink extraction pipes 163 and the tubes 15.

In addition, the inkjet printer 2 is configured to record an image on a recording sheet of paper P that is conveyed leftwards in FIG. 1 by the conveying mechanism 6 by causing the ink of four colors to be ejected from the plurality of nozzles of the inkjet head 5 on to the recording sheet paper P while moving the inkjet head 5 together with the carriage 9 in the direction perpendicular to the surface of the sheet of FIG. 1.

The inkjet printer 2 further includes a purge mechanism 11 configured to suck air, which entered or is generated in the ink flow paths of the inkjet head 5, or thickened ink, from the nozzles 5*a*. Ink may be thickened after water is evaporated from ink at the nozzles. This purge mechanism 11 is configured to move towards and away from an ink ejection surface (a lower surface, in FIG. 1) of the inkjet head 5 where the plurality of nozzles 5*a* are formed, and includes a purge cap 12 to selectively cover the ink ejection surface of the inkjet head 5 and a suction pump 13 configured to suck air or ink from the nozzles 5*a*. In maintenance operation, the suction pump 13 performs the sucking operation with the ink ejection surface covered with the purge cap 12, thereby the purge mechanism 11 forcibly discharges, from the nozzles 5*a*, air in the ink flow paths or thickened ink.

Next, the ink cartridge 4 will be described by reference to FIGS. 2 to 6. Note that since the four ink cartridges which store the ink of four colors individually all have the same, or similar structure, in the following description, one of the four ink cartridges will be described, and the description of the other three ink cartridges will be omitted.

Figure 2:
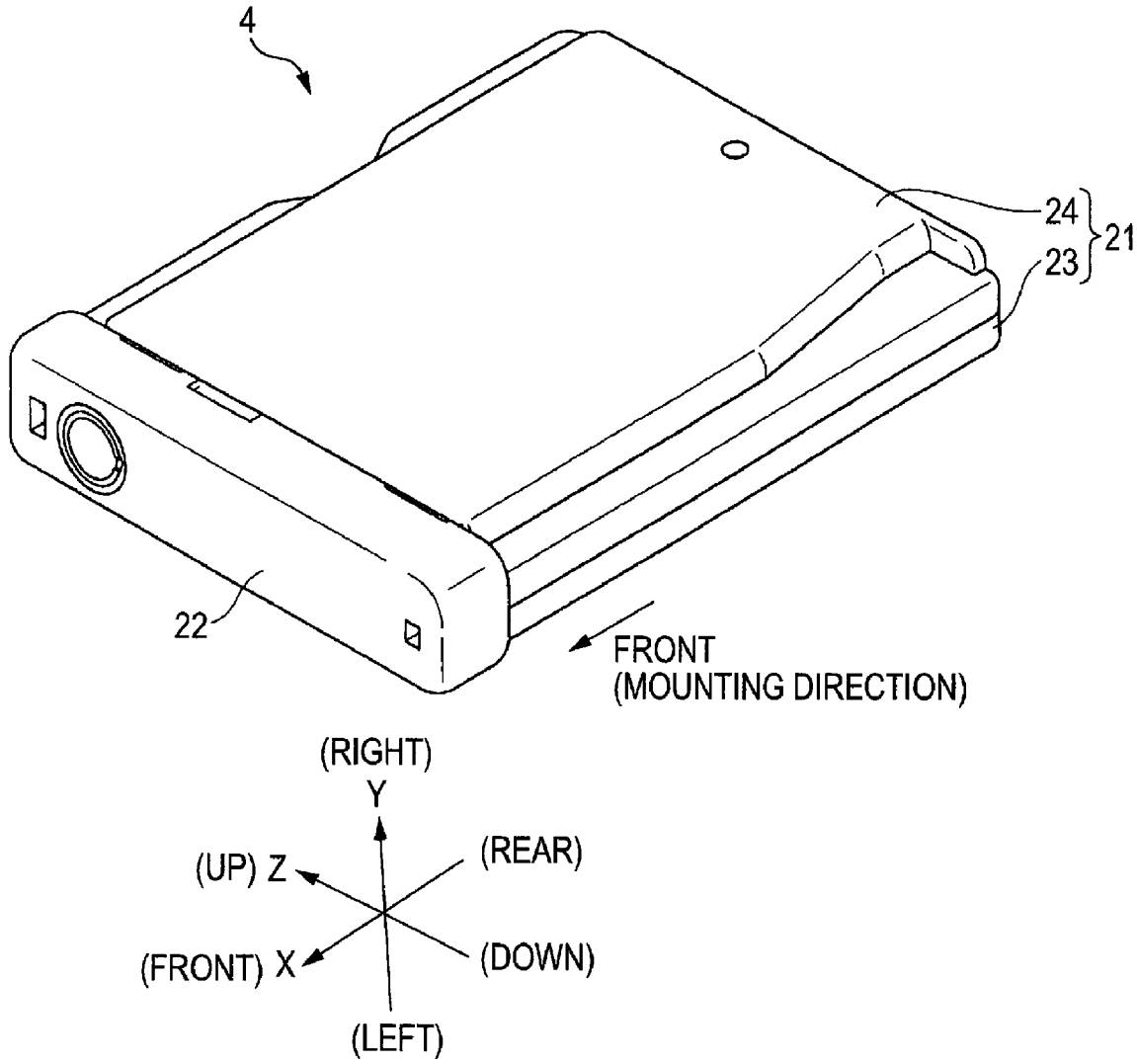
FIG. 2 is a perspective view of an ink cartridge used in the inkjet recording system of FIG. 1.

As shown in FIG. 2, the ink cartridge 4, has a substantially hexahedron shape (a substantially rectangular parallelepiped shape) with six faces extending along an X-axis, Y-axis and Z-axis, respectively. In this embodiment, the ink cartridge 4 has a front face, a rear face opposite the front face, a top face, a bottom face opposite the top face, a left side face and a right side face opposite the left side face. Each of the top face and the bottom face is connected to the front face and the rear face, and each of the right side face and the left side face is connected to the front face, the rear face, the top face, and the bottom face. Each of the front face, the rear face, the top face, the bottom face, the right side face, and the left side face is substantially parallel to the opposing face and substantially perpendicular to the other faces. Each of the left side face and the right side face has a substantially rectangular shape having longer sides extending along the X-axis direction and shorter sides extending along the Z-axis direction. Each of an area of the right side face and an area of the left side face is greater than each of an area of the front face, an area of the rear face, an area of the top face, and an area of the bottom face. The ink cartridge 4 has a width between the right side face and the left side face in the Y-axis direction, a depth between the front face and the rear face in the X-axis direction, and a height between the top face and the bottom face in the Z-axis direction. The X-axis direction, the Y-axis direction, and the Z-axis direction are perpendicular to one another. The ink cartridge 4 is mounted in the cartridge mounting unit 8 from the front face along the X-axis direction with the Z-axis direction aligned with the gravitational direction and X-axis dereliction and Y-axis direction aligned with the horizontal direction.

Figure 3:
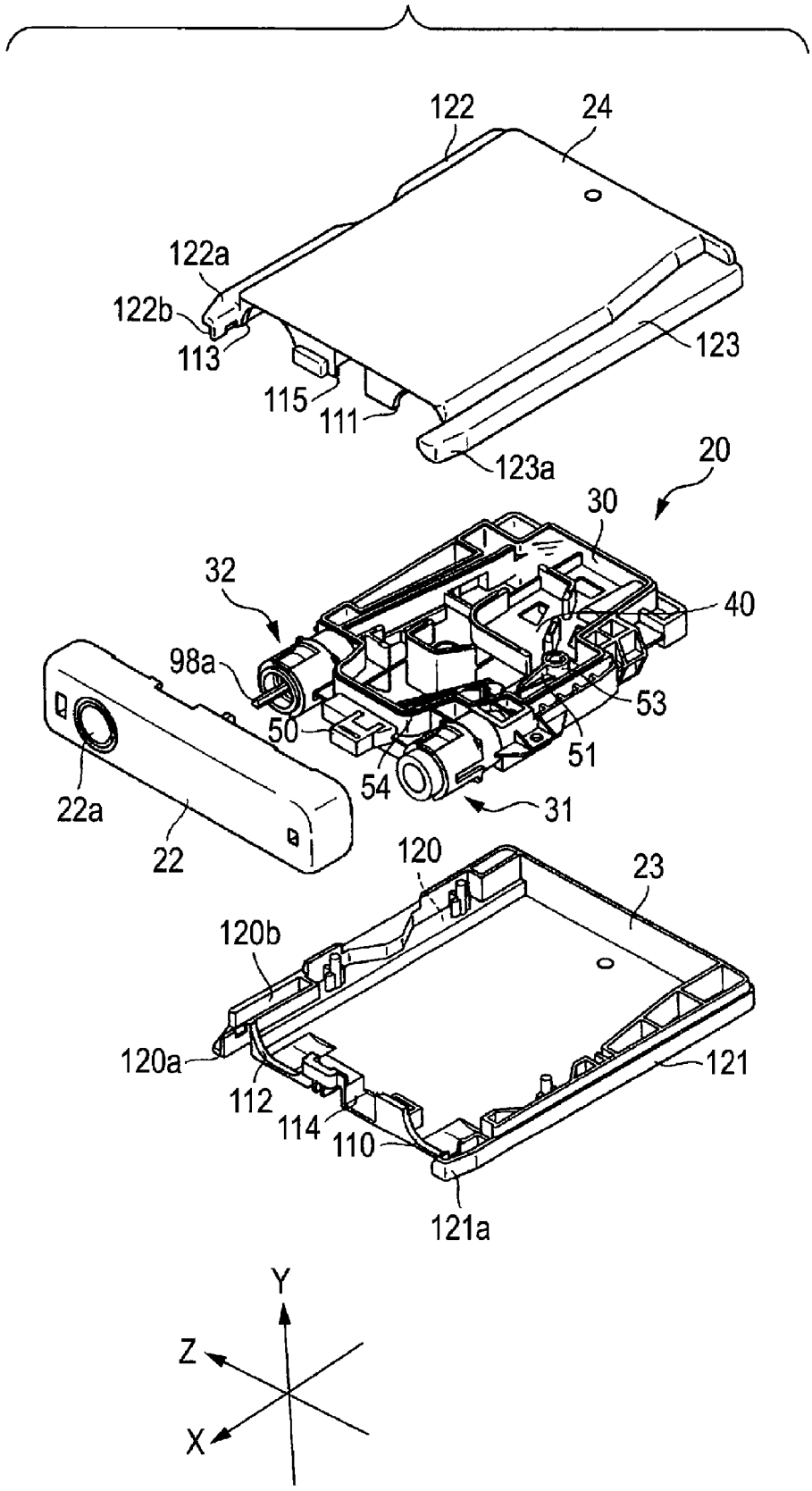
FIG. 3 is an exploded perspective view of the ink cartridge of FIG. 2.

As is shown in FIGS. 2 and 3, the ink cartridge 4 includes: a cartridge main body 20 configured to store ink; an external case 21 which covers substantially the entirety of the cartridge main body 20; and a protector 22 mounted on a front side of the external case 21. Note that in this embodiment, the cartridge main body 20, the external case 21 and the protector 22 are formed of a synthetic resin material such as nylon, polyethylene or polypropylene, respectively.

As is shown in FIG. 3, the cartridge main body 20 includes an ink storage portion 30 having an ink storage chamber 40 defined therein and the ink storage chamber 40 is configured to store ink. The cartridge main body 20 further includes an ink supply portion 31 provided at a front wall 30*a* (see FIG. 5)

of the ink storage portion 30 so that ink stored in the ink storage chamber 40 is supplied to an outside of the cartridge main body 20 therethrough, and an atmospheric introduction portion 32 provided at the front wall 30*a* of the ink storage portion 30 so that the atmosphere is introduced into the ink storage chamber 40 therethrough. When the ink cartridge 4 is mounted in the cartridge mounting unit 8, the ink supply portion 31 is positioned below the atmospheric introduction portion 32. The cartridge main body 20 also includes an ink injection portion 60 that allows ink to be introduced into the ink storage chamber 40 (see FIG. 4). In addition, as will be described later, each of the atmospheric introduction portion 32 and the ink injection portion 60 serves as a atmospheric communication portion between the ink storage chamber 40 and the atmosphere outside the cartridge main body 20, i.e., outside the ink cartridge 4, in an ink filling method according to the first embodiment. Namely, the configuration of the ink cartridge 4 according to the first embodiment provides two atmospheric communication portions.

Figure 4:
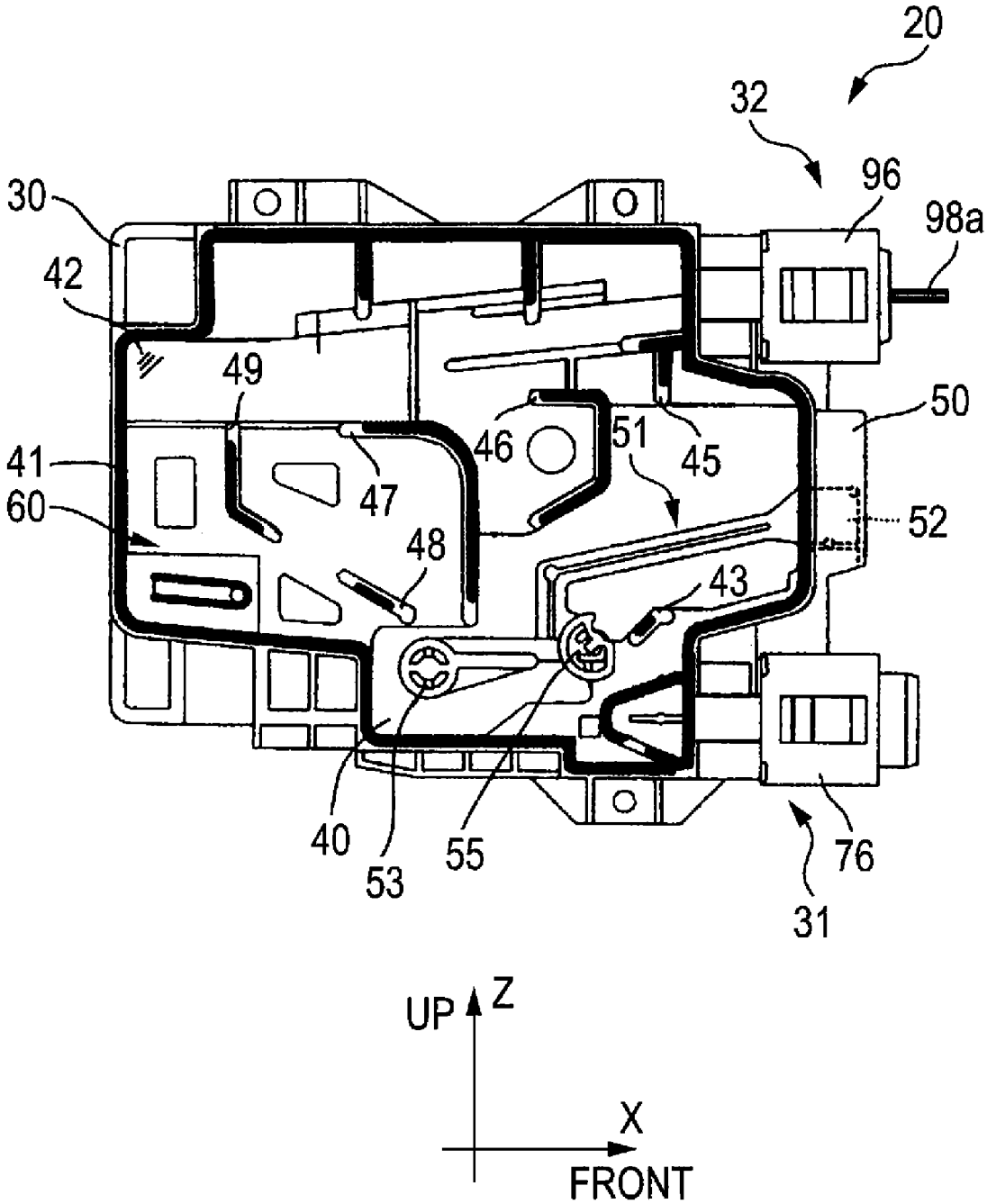
FIG. 4 is a left side view of a cartridge main body shown in FIG. 3.

As shown in FIG. 4, the ink storage portion 30 includes a frame portion 41, ribs 43 to 49 which are connected to the frame portion 41, and two films 42 which are respectively adhered to the frame portion 41 and the ribs 43 to 49 (in particular, portions in bold lines in FIG. 4) from both left and right sides. The ink storage chamber 40 corresponds to a space defined by the frame portion 41 and the two films 42 and is capable of storing ink therein. The films 42 are adhered to the frame portion 41 and the ribs 43 to 49 by means, for example, of ultrasonic welding. According to this configuration, when compared to a case where the periphery of the ink storage chamber 40 is surrounded entirely by a wall portion relatively thicker than the films 42, the thickness (width) of the ink storage portion 30 can be reduced. In addition, a reduction in strength resulting from the use of the films 42 can be compensated for by the ribs 43 to 49.

As shown in FIG. 4, a detected portion 50 is provided at the front wall 30*a* (a right end portion in FIG. 4) of the ink storage portion 30, and the detected portion 50 projects forwards (towards a distal end side in the mounting direction) from a portion of the frame portion 41. The detected portion 50 is formed of a material which allows light, e.g., infrared light, to pass therethrough. The detected portion 50 has an inner space formed therein, and an inner space of the detected portion 50 communicates with the ink storage chamber 40 from the rear side of the detected portion 50 via the frame portion 41.

A sensor arm 51 is provided in the ink storage chamber 40. The sensor arm 51 extends substantially along the X-axis direction in a lower portion of the ink storage chamber 40. A shading plate 52 is fixed to a front end of the sensor arm 51, and a float 53 is fixed to a rear end thereof. The float 53 has a specific gravity which is smaller than that of ink stored in the ink storage chamber 40 and is configured to move to follow the ink level in the ink storage chamber 40. The sensor arm 51 is pivotally supported at an arm support portion which is situated between the shading plate 52 and the float 53 as a pivot, whereby when the float 53 moves to follow the ink level in the ink storage chamber 40, the shading plate 52 moves within the detected portion 50. When the ink cartridge 4 is mounted in the ink cartridge mounting unit 8, a lower end portion of the detected portion 50 is positioned between a light emitting unit and a light receiving unit of an optical sensor (not shown) which is provided in the cartridge mounting unit 8. The inkjet printer 2 can determine whether the amount of ink in the ink storage chamber 40 is sufficient by detecting whether the shading plate 52 is positioned between the light emitting unit and the light receiving unit of the optical sensor.

Figure 5:
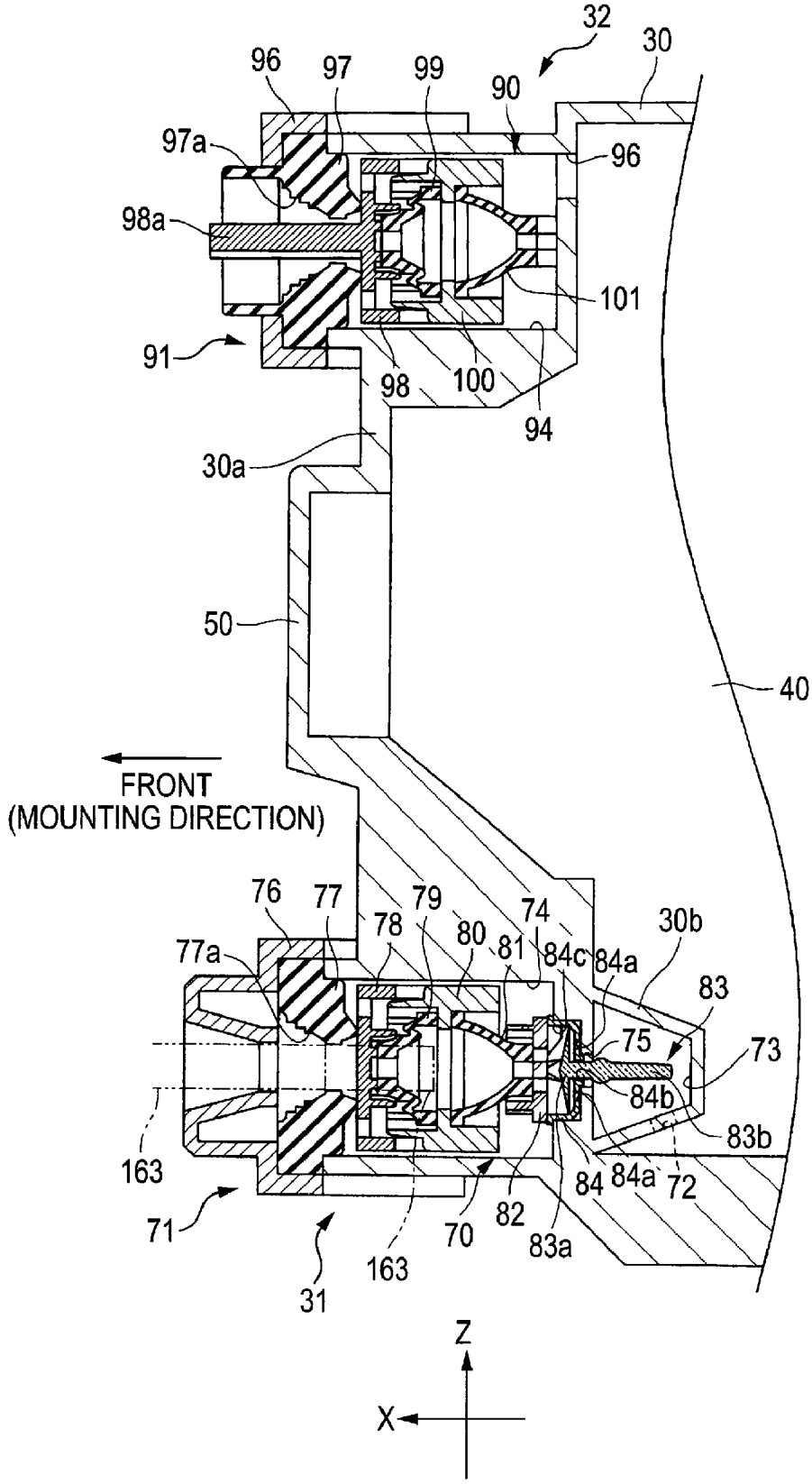
FIG. 5 is a partially cross-sectional view of the cartridge main body of FIG. 3 as viewed from a right side thereof.

Next, the ink supply portion 31 and the atmospheric introduction portion 32 will be described. As is shown in FIG. 5, the ink supply portion 31 and the atmospheric introduction portion 32 extend horizontally and forwards, respectively, from upper and lower end portions of the front wall 30*a* of the ink storage portion 30 when the ink cartridge 4 is mounted in the cartridge mounting unit 8, and the detected portion 50 is positioned between the ink supply portion 31 and the atmospheric introduction portion 32. The ink supply portion 31 and the atmospheric introduction portion 32 are configured so that ink stored in the ink storage chamber 40 is supplied to the outside of the cartridge main body 20 via the ink supply portion 31 while the atmospheric air is introduced from the outside of the cartridge main body 20 into the ink storage chamber 40 via the atmospheric introduction portion 32. Note that the illustration of the sensor arm 51 is omitted in FIG. 5.

When the ink cartridge 4 is mounted to the cartridge mounting unit 8, the atmospheric introduction portion 32 is positioned adjacent to an upper end the ink storage portion 30, and the ink supply portion 31 is positioned adjacent to a lower end of the ink storage portion 30. Accordingly, the atmospheric air can be introduced smoothly into an upper space of the ink storage chamber 40 via the atmospheric introduction portion 32, while ink remaining in a lower space of the ink storage chamber 40 can be consumed as much as possible.

As is shown in FIG. 5, the ink supply portion 31 includes an ink supply path 70 which communicates with the ink storage chamber 40 provided in the ink storage portion 30, and a first open/close mechanism 71 configured to selectively open and close the ink supply path 70. The ink supply path 70 is bounded by a partitioning wall 30*b* which is provided in the frame portion 41 and which is connected to the front wall 30*a* of the ink storage portion 30, and the ink supply path 70 includes a pre-supply chamber 73, and a first accommodation chamber 74 (an ink supply chamber). The pre-supply chamber 73 is positioned in the frame portion 41 and defined by the front wall 30*a* and the partitioning wall 30*b*, and the first accommodation chamber 74 is positioned outside the frame portion 41 and defined by the front wall 30*a* at one end and opens to the outside of the cartridge main body 20 at the other end. The first accommodation chamber 74 accommodates therein most part of the first open/close mechanism 71, and a communication hole 75 is formed through the front wall 30*a* to bring the pre-supply chamber 73 into communication with the first accommodation chamber 74. The pre-supply chamber 73 communicates with the ink storage chamber 40 via a communication hole 72 formed through the partitioning wall 30*b*. In addition, the ink supply path 70 extends substantially horizontally and forwards as a whole, and ink stored in the ink storage chamber 40 flows out from the pre-supply chamber 73 into the first accommodation chamber 74 via the communication hole 75.

The first open/close mechanism 71 includes a supply cap 76, a supply joint 77, a supply valve 78 (a valve body), a first supply spring 79 (an urging member), a supply slider 80, a second supply spring 81 (an urging member), a valve seat 82, a check valve 83 and a cover 84.

The supply cap 76 is mounted to an area surrounding the open end of the first accommodation chamber 74 to partially cover the first accommodation chamber 74. The supply joint 77 is made of a material such as rubber having elasticity and is formed into an annular shape having a through hole 77*a* in a center portion thereof, and the supply joint 77 partially closes the open end of the first accommodation chamber 74. The supply valve 78 is provided in the first accommodation chamber 74 and configured to move along the X-axis direction between a close position where the supply valve 78 closes the through hole 77*a* (an ink supply hole) so as to close the ink supply path 70 and an open position where the supply valve 78 is positioned apart from the supply joint 77 to open the supply path 70.

The first supply spring 79 and the second supply spring 81 are formed of the same material and formed into substantially the same shape. The first supply spring 79 and the second supply spring 81 are disposed to face each other sandwiching the supply slider 80 therebetween. A front end of the first supply spring 79 is brought into contact with the supply valve 78, and a rear end of the second supply spring 81 is brought into contact with the valve seat 82. The supply slider 80 is disposed at the rear side of the supply valve 78 (to the right in FIG. 5), is capable of moving back and forth (along X-axis direction) in the first accommodation chamber 74 and is urged forwards by the second supply spring 81. Namely, the supply slider 80 is urged forwards by the second supply spring 81, and furthermore, the urging force is applied to the supply valve 78 via the first supply spring 79. As a result, the supply valve 78 is urged forwards, i.e., towards the close position where the supply valve 78 closes the through hole 77*a* of the supply joint 77.

The check valve 83 includes a stem portion 83*b* and a valve main body 83*a*, and the valve main body 83*a* is enclosed by the valve seat 82 and the cover 84. The valve seat 82 is disposed at a rear end of the second supply spring 81. Through holes are formed along the X-axis direction through the valve seat 82, and the rear end of the second spring 81 is brought into contact with a surface of the vale seat 82 at an area surrounded by the through holes. The cover 84 is brought into contact with the valve seat 82 to cover a rear side of the valve seat 82. A space for accommodating a valve main body 83*a* of the check valve 83 is formed between an inner surface 84*c* of the cover 84 and the valve seat 82. Communication holes 84*a* and a communication hole 84*b*, which communicate with the communication hole 75, are formed through the cover 84. The space accommodating the valve main body 83*a* communicates with the pre-supply chamber 73 via the communication holes 84*a* and the communication hole 75, and communicates with the space within the first accommodation chamber 74 via the through holes formed through the valve seat 82.

The stem portion 83*b* of the check valve 83 extends through the communication hole 84*b* from the front side to the rear side of the communication hole 84*b*. In addition, the valve main body 83*a* is covered by the valve seat 82 from the front side. The check valve 83 is formed of an elastic material such as a resin and is elastically deformed depending on a pressure differential between the pressure in the first accommodation chamber 74 and the pressure in the pre-supply chamber 73 and the ink storage chamber 40. In addition, when the pressure in the first accommodation chamber 74 is larger than the pressure in the pre-supply chamber 73 and the ink storage chamber 40 by a predetermined value, the valve main body 83*a* is elastically deformed to close the communication holes 84*a* to thereby close the communication hole 75, whereas when the pressure in the first accommodation chamber 74 is not larger than the pressure in the pre-supply chamber 73 and the ink storage chamber 40 by the predetermined valve, the valve main body 83*a* is opens the communication holes 84*a* to thereby open the communication hole 75. Accordingly, ink flows out smoothly from the ink storage chamber 40 to the first accommodation chamber 74, whereas a reverse flow of ink from the first accommodation chamber 74 to the ink storage chamber 40 is prevented.

In the configuration described above, when the ink cartridge 4 is not mounted in the cartridge mounting unit 8, a front side of the supply valve 78 which is urged forwards is brought into contact with a rear end of the supply joint 77. This allows the through hole 77*a* of the supply joint 77 to be closed by the supply valve 78, which ensures the prevention of the leakage of ink from the ink supply portion 31. On the other hand, when the ink cartridge 4 is mounted in the cartridge mounting unit 8, the ink extraction pipe 163 provided at the cartridge mounting unit 8 is inserted into the through hole 77*a* of the supply joint 77 along the X-axis direction. Then, the supply valve 78 which is closing the through hole 77*a* is pushed rearwards against the urging force of the second supply spring 81 by a distal end of the ink extraction pipe 163. Then, the supply valve 78 moves away from the supply joint 77 to open the through hole 77*a*, whereupon ink stored in the ink storage chamber 40 is introduced into the ink extraction pipe 163 via the ink supply path 70.

As is shown in FIG. 5, the atmospheric introduction portion 32 includes an atmosphere introducing path 90 which communicates with the ink storage chamber 40 in the ink storage portion 30 and a second open/close mechanism 91 configured to selectively open and close the atmosphere introducing path 90. The atmosphere introducing path 90 includes a second accommodation chamber 94 which is positioned outside the frame portion 41 and defined by the front wall 30*a* of the ink storage portion 30 at one end and opens to the outside of the cartridge main body 20 at the other end. The second accommodation chamber 94 accommodates therein most of the second open/close mechanism 91, and a communicating hole 95 is formed through the front wall 30*a* to allow a communication between the ink storage chamber 40 and the second accommodation chamber 94. The atmosphere introducing path 90 extends substantially forwards and horizontally as a whole and is configured such that the atmospheric air is introduced into the ink storage chamber 40 via the second accommodation chamber 94 and the communicating hole 95.

The second open/close mechanism 91 includes an atmospheric cap 96, an atmospheric joint 97, an atmospheric valve 98, a first atmospheric spring 99, an atmospheric slider 100 and a second atmospheric spring 101.

The atmospheric cap 96 is mounted to an area surrounding the open end of the second accommodation chamber 94 to partially cover the second accommodation chamber 94. The atmospheric joint 97 is made of an elastic material such as a rubber, is formed into an annular shape having a through hole 97*a* in a center portion thereof. The atmospheric joint 97 partially closes the open end of the second accommodation chamber 94. The atmospheric valve 98 is provided in the second accommodation chamber 94 and configured to move along the X-axis direction between a close portion where the atmospheric valve 98 closes the through hole 97*a* of the atmospheric joint 97 so as to close the atmosphere introducing path 90 and an open position where the atmospheric valve 98 is positioned apart from the atmospheric joint 97 to open the atmosphere introducing path. A projecting portion 98*a* extends from a front side of the atmospheric valve 98 forward (in the X-axis direction) through the through hole 97*a* of the atmospheric joint 97. The distal end of the projecting portion 98*a* projects from the front ends of the atmospheric cap 96 and the atmospheric joint 97.

The first atmospheric spring 99 and the second atmospheric spring 101 are made of the same material and formed into substantially the same shape. The first atmospheric spring 99 and the second atmospheric spring 101 are disposed to face each other sandwiching the atmospheric slider 100 therebetween. A front end of the first atmospheric spring 99 is brought into contact with the atmospheric valve 98 and a rear end of the second atmospheric spring 101 is brought into contact with a rear end of the second accommodation chamber 94. The atmospheric slider 100 is disposed at the rear side of the atmospheric valve 98 (to the right in FIG. 5) and is capable of moving back and forth (along the X-axis direction) within the second accommodation chamber 94. The atmospheric slider is urged forwards by the second atmospheric spring 101. Namely, the atmospheric slider 100 is urged forwards by the second atmospheric spring 101, and furthermore, the urging force is applied to the atmospheric valve 98 via the first atmospheric spring 99. As a result, the atmospheric valve 98 is urged forwards to the close position where the atmospheric valve 98 closes the through hole 97*a* of the atmospheric joint 97.

In the configuration described above, when the ink cartridge 4 is not mounted in the cartridge mounting unit 8, a front side of the atmospheric valve 98 which is urged forwards is brought into contact with a rear end face of the atmospheric joint 97, and the through hole 97*a* of the atmospheric joint 97 is closed by the atmospheric valve 98, whereby communication between the inside of the ink storage chamber 40 and the outside of the cartridge main body 20 is prevented or at least suppressed. Therefore, ink stored in the ink storage chamber 40 is prevented from being dried, and the change in properties of the ink is also prevented. On the other hand, when the ink cartridge 4 is mounted in the ink cartridge mounting unit 8, the atmospheric valve 98 is pushed rearwards against the urging force of the second atmospheric spring 101 by the projecting portion 98*a* of the atmospheric valve 98 being brought into contact with the cartridge mounting unit 8. As this occurs, the atmospheric valve 98 moves away from the atmospheric joint 97, whereby the atmosphere introducing path 90 is opened, and the atmospheric air is introduced into the ink storage chamber 40 via the atmosphere introducing path 90.

Figure 6A:
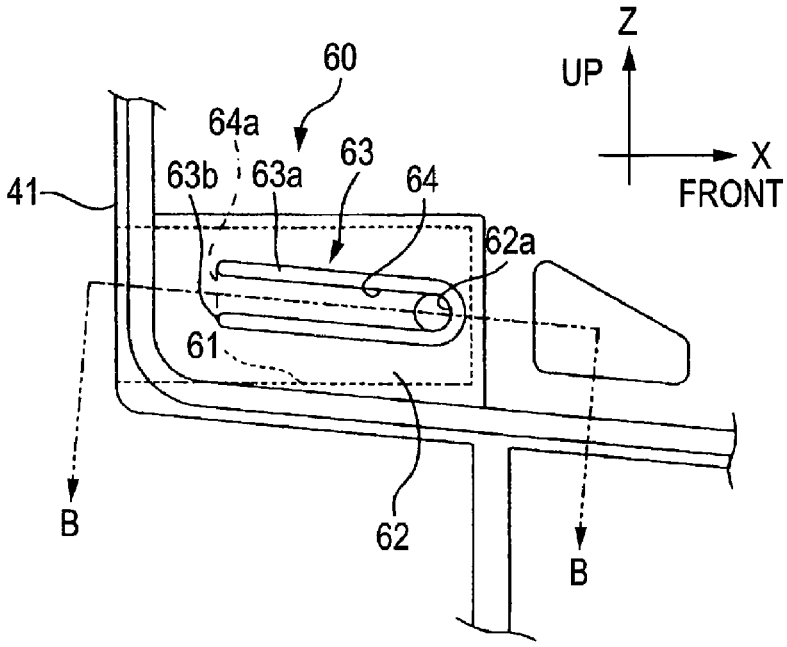
FIG. 6A is an enlarged view of a portion in the vicinity of an ink injection portion shown in FIG. 4.

Next, the ink injection portion 60 will be described with reference to FIGS. 6A and 6B.

The ink injection portion 60 has an injection chamber 61 formed to extend substantially forwards from a rear end of the ink storage portion 30 along the X-axis direction. The injection chamber 61 is defined by a partitioning wall 62. The partitioning wall 62 has substantially a cylindrical shape and is formed integrally with the frame portion 41. A communication hole 62*a* is formed through the partitioning wall 62. In addition, a U-shaped partitioning wall 63 is formed integrally on the partitioning wall 62. The partitioning wall 63 extends from the partitioning wall 62 towards the interior of the ink storage chamber 40 in a direction substantially perpendicular to the partitioning wall 62. In addition, the film 42 is adhered to an end face 63*a* of the partitioning wall 63. An injection flow path 64 is defined by the film 42 and the partitioning walls 62 and 63. The injection flow path 64 opens to the space in the ink storage chamber 40 at an opening 64*a* formed between distal ends 63*b* of the U-shape of the partitioning wall 63. A space 61*b* in the injection chamber 61 communicates with the space within the ink storage chamber 40 via the communication hole 62*a*, the injection flow path 64 and the opening 64*a*.

Figure 6B:
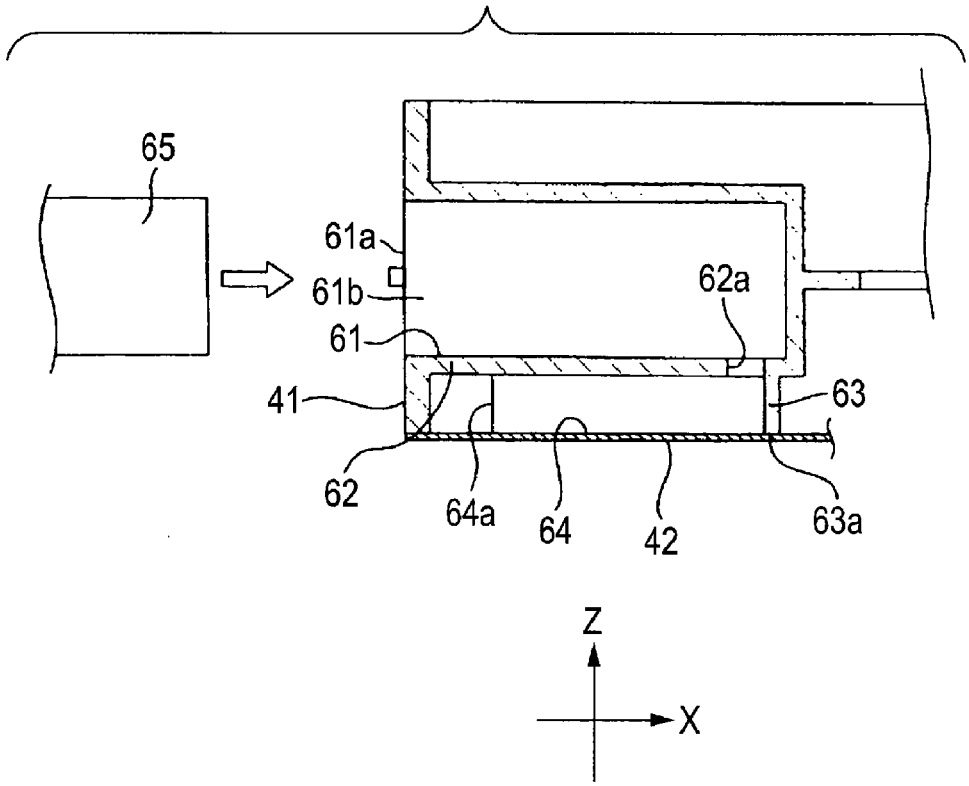
FIG. 6B is a cross-sectional view taken along the line B-B of FIG. 6A.
Figure 7:
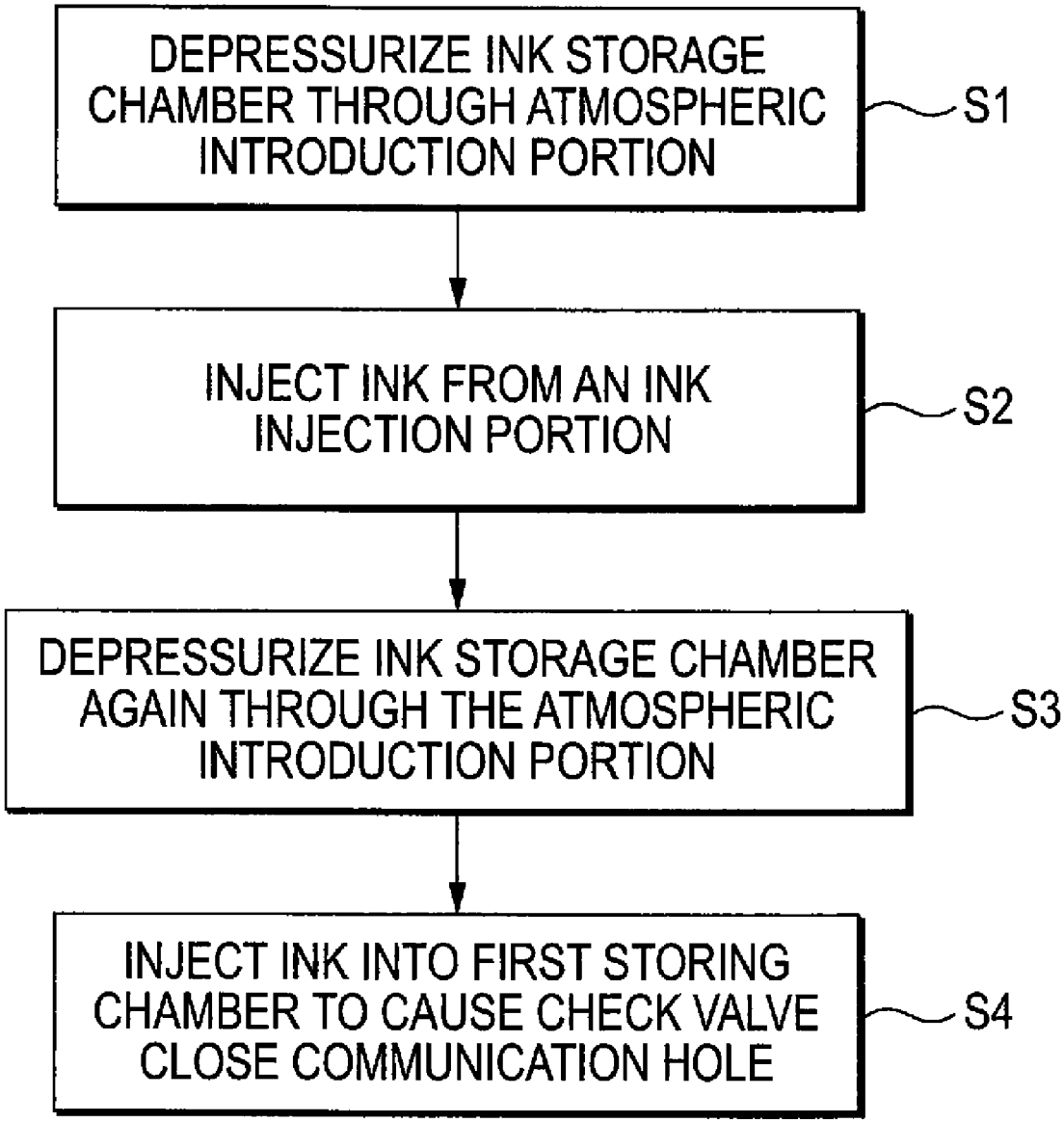
FIG. 7 is a flow chart showing a series of steps in an ink filling method for the ink cartridge of FIG. 2.

A rubber plug 65 is inserted into the injection chamber 61 along a white thick arrow in FIG. 6B. Although the rubber plug 65 has substantially the same shape as the injection chamber 61, the rubber plug 65 is formed slightly larger in size than the injection chamber 61, so as to be inserted into the injection chamber 61 while being compressed. When introducing ink into the ink storage chamber 40 via the ink injection portion 60, a metallic pipe having an outlet through which ink flows out is caused to pierce the rubber plug 65, for example, so that the outlet communicates with the communication hole 62*a*. Then, ink is caused to flow from the outlet into the communication hole 62*a*. After the introduction of ink has been completed, the metallic pipe is pulled out from the rubber plug 65. The rubber plug 65 will not be removed from the ink injection chamber 61, and the cartridge 4 is used with the rubber plug 65 positioned in the injection chamber 61. However, since an opening formed in the rubber plug 65 by the metallic pipe penetrating through the rubber plug 65 is closed due to the elasticity of the rubber plug 65, ink does not leak from the opening formed in the rubber plug 65.

Next, the external case 21 will be described with reference to FIGS. 2 and 3. The external case 21 is substantially rectangular parallelepiped and is made up of two case members, a first case member 23 and a second case member 24, which hold the ink storage portion 30 therebetween from left and right sides of the ink storage portion 30. The first case member 23 covers one side of the ink storage portion 30, and the second case member 24 covers the other side of the ink storage portion 30. In addition, the first case member 23 and the second case member 24 are molded individually from a synthetic resin material by means of an injection molding or the like.

The first case member 23 and the second case member 24 are formed substantially into the same shape. Cut-out portions 110 and 111 and cut-out portions 112 and 113 are formed through front end portions of the first case member 23 and the second case member 24, respectively. When the first case member 23 and the second case member 24 accommodate the ink storage portion 30, the cut-out portions 110 and 111 form a substantially circular through hole from which a part of the ink supply portion 31 is exposed to the outside, and the cut-out portions 112 and 113 form a substantially circular through hole from which a part of the atmospheric introduction portion 32 is exposed to the outside. Further, cut-out portions 114 and 115 are formed through the front end portions of the first case member 23 and the second case member 24, respectively, and the cut-out portions 114 and 115 form a through hole. The optical sensor provided in the cartridge mounting unit 8 is inserted from the through hole to a position where the detected portion 50 is located between the light emitting and light receiving units of the optical sensor.

Stepped portions 120 and 121 are formed at end portions of the first case member 23 in Z-axis direction to extend along the X-axis direction. Similarly, stepped portions 122 and 123 are also formed at end portions of the second case member 24 in Z-axis direction to extend along the X-axis direction. When the first case member 23 is connected to the second case member 24, each of a width between the stepped portion 120 and the stepped portion 122 and a with between the stepped portion 121 and the stepped portion 123 is less than a width between a portion of the first case member 23 other than the stepped portions 120 and 121 and a portion of the second case member 24 other than the stepped portions 122 and 123. The first case member 23 and the second case member 24 which face each other are welded together at these stepped portions 120 to 123. Namely, the stepped portion 120 and the stepped portion 122 both positioned adjacent to the atmospheric introduction portion 32 are welded together, and the stepped portion 121 and the stepped portion 123 both positioned adjacent to the ink supply portion 31 are welded together. The stepped portions 120 to 123 have projecting portions 120*a* to 123*a* which project further forwards than front end faces of the first case member 23 and the second case member 24. In addition, fitting grooves 120*b*, 122*b* are formed, respectively, at the two projecting portions 120*a* and 122*a* to extend from front end toward the rear side.

Next, the protector 22 will be described by reference to FIGS. 2 and 3. The protector 22 covers the front wall 30*a* of the ink storage portion 30 where the ink supply portion 31 and the atmospheric introduction portion 32 are provided, so that the protector 22 protects the ink supply portion 31 and the atmospheric introduction portion 32 when the cartridge 4 is shipped. As shown in FIG. 3, a protector through hole 22*a* is formed through the protector 22 at a position facing the atmospheric introduction portion 32. The protector 22 can cover the ink supply portion 31 and the atmospheric introduction portion 32 while allowing the projecting portion 98*a* of the atmospheric valve 98 to be positioned in the protector through hole 22*a*, thereby capable of ensuring a protection for both the ink supply portion 31 and the atmospheric introduction portion 32. In addition, the protector 22 is removed such that the ink supply portion 31 and the atmospheric introduction portion 32 are exposed before the ink cartridge 4 is mounted in the cartridge mounting unit 8 of the holder 7.

Hereinafter, an ink filling method for filling the ink storage chamber 40 with ink will be described by reference to FIGS. 7 to 12. In FIGS. 8 to 12, some elements of the ink cartridge 4 are simplified or omitted. In particular, the configurations of the first open/close mechanism 71 and the second open/close mechanism 91 are shown in a simplified fashion.

Figure 8:
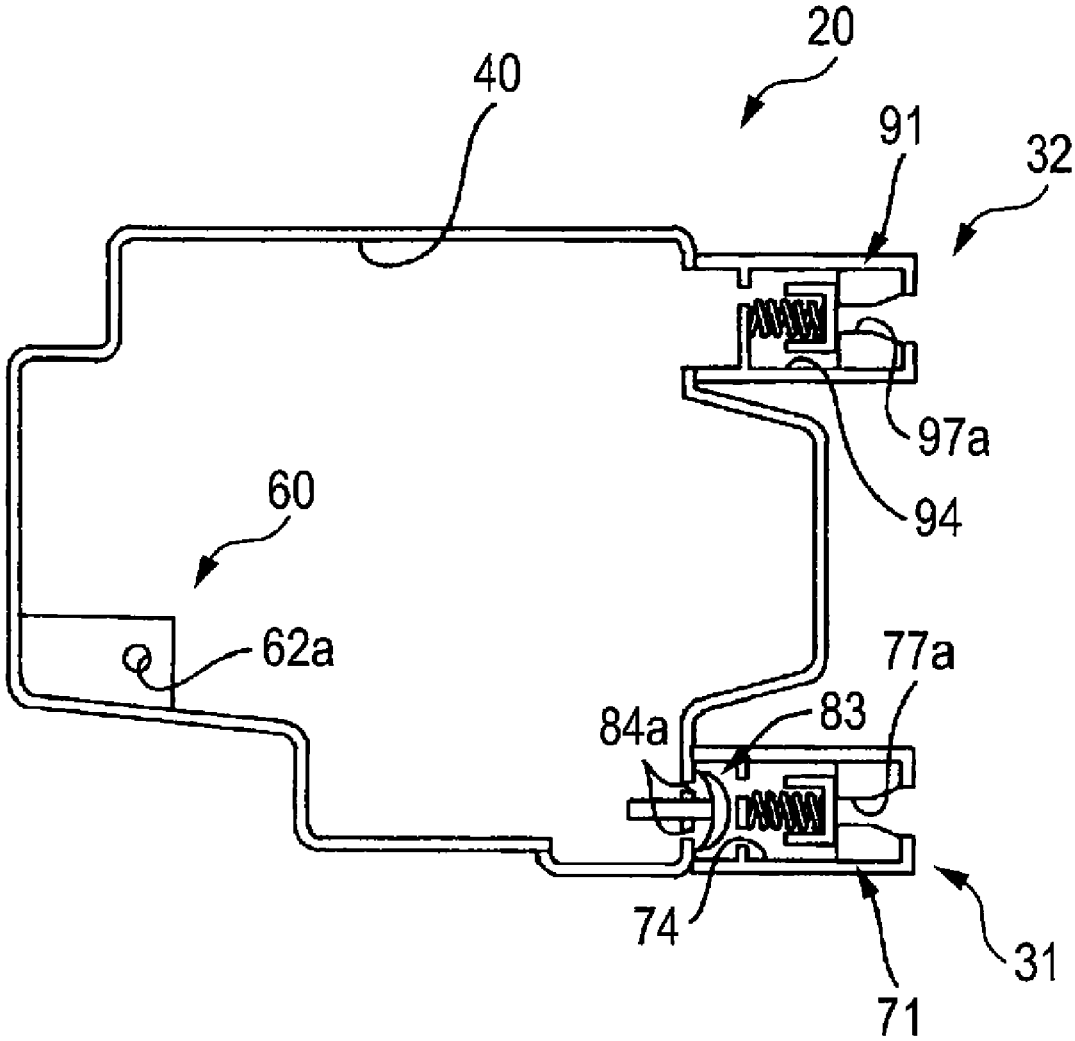
FIG. 8 is a schematic diagram of the cartridge main body before an ink storage chamber is filled with ink by the ink filling method of FIG. 7.

As shown in FIG. 8, before the ink storage chamber 40 is filled with ink, the through holes 77*a* and 97*a* are closed by the first and second open/close mechanisms 71 and 91. In addition, the pressure in the first accommodation chamber 74 and the pressure in the ink storage chamber 40 are equal, the check valve 83 does not close the communication holes 84*a* such that the ink storage chamber 40 and the first accommodation chamber 74 communicate with each other via the communication holes 84*a* and the communication hole 75.

Figure 9A:
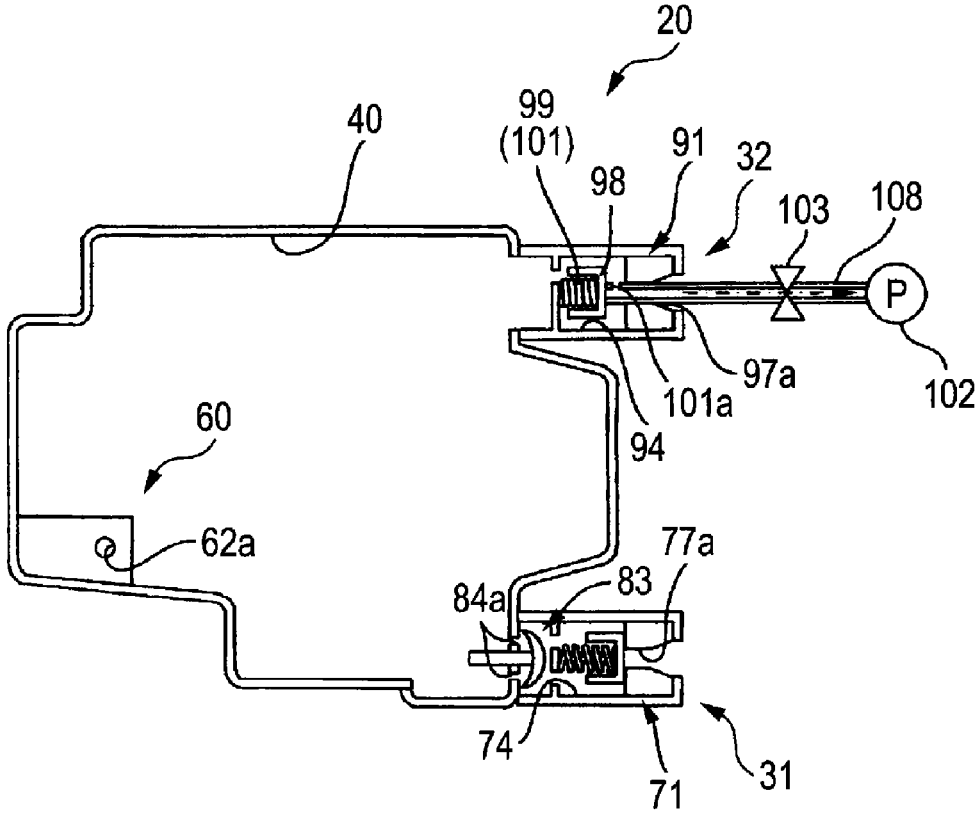
FIG. 9A is a schematic diagram showing the cartridge main body at a step of depressurizing an ink storage chamber in the ink filling method of FIG. 7.
Figure 9B:
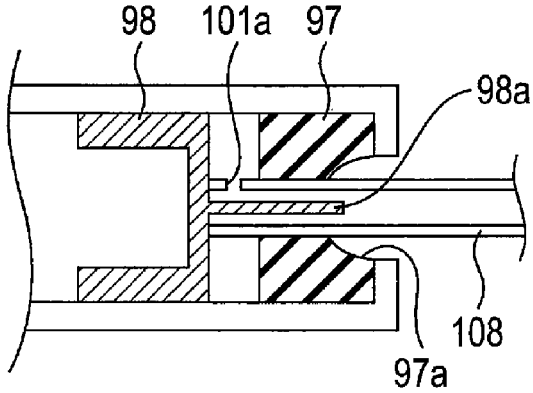
FIG. 9B is an enlarged view of an atmospheric communication portion of the cartridge main body in FIG. 9A.

As is shown in FIGS. 9A and 9B, one end of a suction pipe 108 is inserted into the atmospheric introduction portion 32 of the cartridge main body 20, and the one end of the suction pipe 108 is brought into contact with the atmospheric valve 98 while the projecting portion 98*a* is positioned in the suction pipe 108 with a gap between an inner surface of the suction pipe 108 and the projecting portion 98*a*. When the suction pipe 108 is further inserted into the atmospheric introduction portion 32, the suction pipe 108 pushes the atmospheric valve 98 to the rear away from the atmospheric joint 97 against the urging forces of the first atmospheric spring 99 and the second atmospheric spring 101, whereby the through hole 97*a* is caused to open. A suction opening 101*a* is formed in the vicinity of the one end of the suction pipe 108, and the inside of the suction pine 108 communicates with the second accommodation chamber 94 via the suction opening 101*a* when the suction pipe 108 pushes the atmospheric valve 98 to open the through hole 97*a*.

A pump 102 is connected to the other end of the suction pipe 108, and a valve 103 is provided between the one end and the other end of the suction pipe 108. The valve 103 opens and closes to selectively allow and prevent the communication between the one end and the other end of the suction pipe 108. By opening the valve 103 and activating the pump 102, air is discharged from the ink storage chamber 40 via the atmospheric introduction portion 32 as indicated by an arrow followed by an alternate long and short dash line, whereby the air pressure within the ink storage chamber 40 is reduced and the ink storage chamber 40 is depressurized, so as to produce a pressure of a value P1 which is lower than the atmospheric pressure (S1 in FIG. 7; a first depressurization step) P1 is set as, for example, a pressure which is smaller than the atmospheric pressure by 90 kPa (kilo Pascal).

Figure 10A:
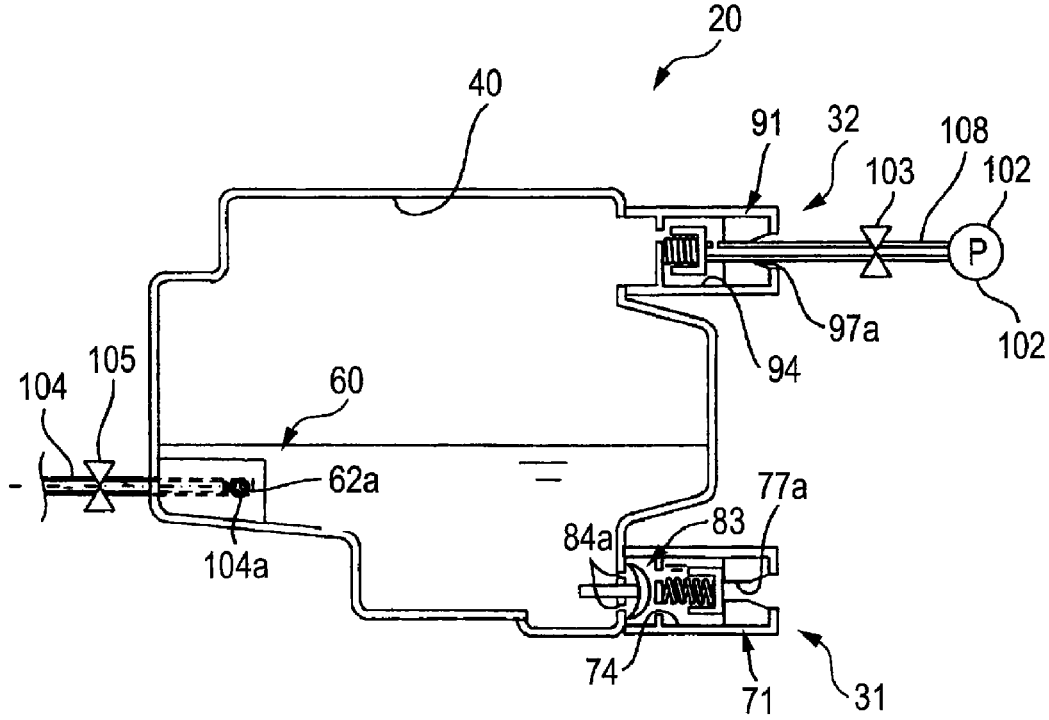
FIGS. 10A and 10B are schematic diagrams showing the cartridge main body at a step of injecting ink into the ink storage chamber in the ink filling method of FIG. 7.
Figure 10B:
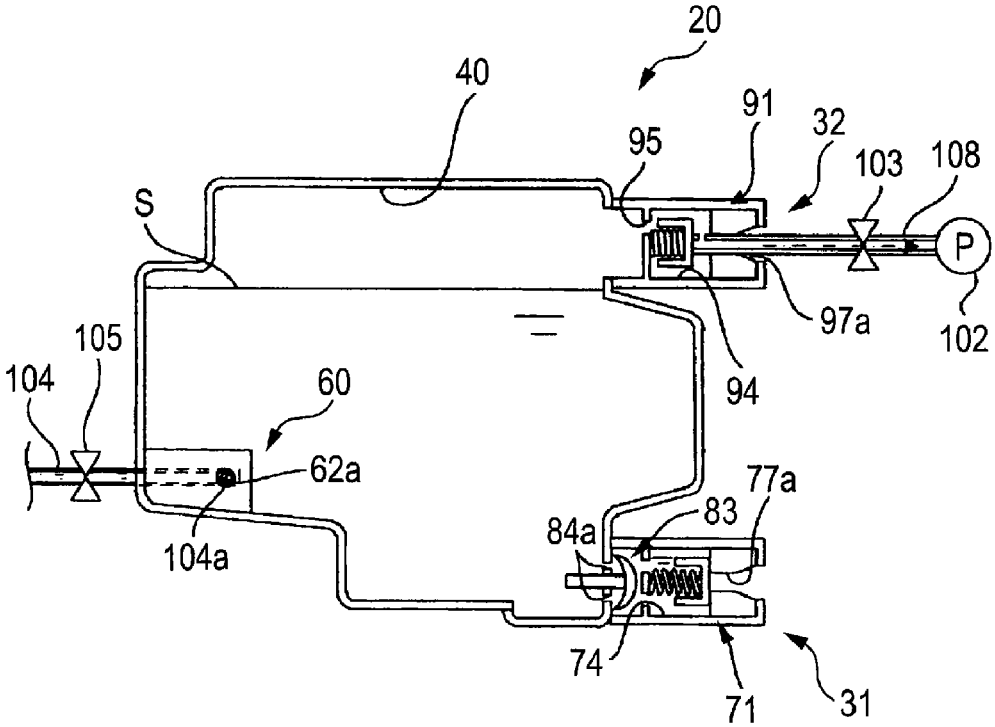

Next, as is shown in FIG. 10A, one end of an injection pipe 104 is inserted into the rubber plug 65 positioned in the ink injection portion 60. A communication hole 104*a* is formed in the vicinity of the one end of the injection pipe 104, and the injection pipe 104 is inserted to a position where the communication hole 104*a* communicates with the communication hole 62*a*. A valve 105 is provided between the one end and the other end of the injection pipe 104. The valve 105 opens and closes to selectively allow and prevent the communication between the one end and the other end of the injection pipe 104. By opening the valve 105 to allow ink to flow in from the other end of the injection pipe 104, ink is injected into the ink storage chamber 40 from the ink injection portion 60 via the communication holes 104*a* and 62*a* (S2; an injection step) as is indicated by an arrow followed by a chain double-dashed line. In addition, when a level S of ink reaches a predetermined position lying below the communication hole 95 as is shown in FIG. 10B, the injection of ink is stopped. Note that ink is also injected into the first accommodation chamber 74 via the communication holes 84*a* by this operation.

Here, when ink is injected into the ink storage chamber 40, the pressure in the ink storage chamber 40 may increase higher than the pressure P1. Therefore, after ink is injected into the ink storage chamber 40, the valve 103 is opened and the pump 102 is activated to discharge air from the ink storage chamber 40 as indicated by an arrow followed by an alternate long and short dash line in FIG. 10B, whereby the air pressure in the ink storage chamber 40 is reduced again or the ink storage chamber 40 is depressurized again, so as to produce a pressure having a valve P2 which is lower than the atmospheric pressure (S3 in FIG. 7; a second depressurization step). For example, P2 is set as, for example, a pressure lower than the atmospheric pressure by 90 kPa (kilo Pascal). Note that although the first depressurization step (discharge of air from the ink storage chamber 40), the injection step (injection of ink into the ink storage chamber 40) and the second depressurization step (discharge of air from the ink storage chamber 40) can be performed via the same portion, e.g., the atmospheric introduction portion 32. However, in such a case, it is necessary to attach and detach the suction pipe 108 and the injection pipe 104 between the steps, which takes more time. On the other hand, in this embodiment, however, since the first depressurization step and the second depressurization step, and the injection step are performed via different portions, it is not necessary to attach and detach the suction pipe 108 and the injection pipe 104 between the steps, which takes less time.

Figure 11:
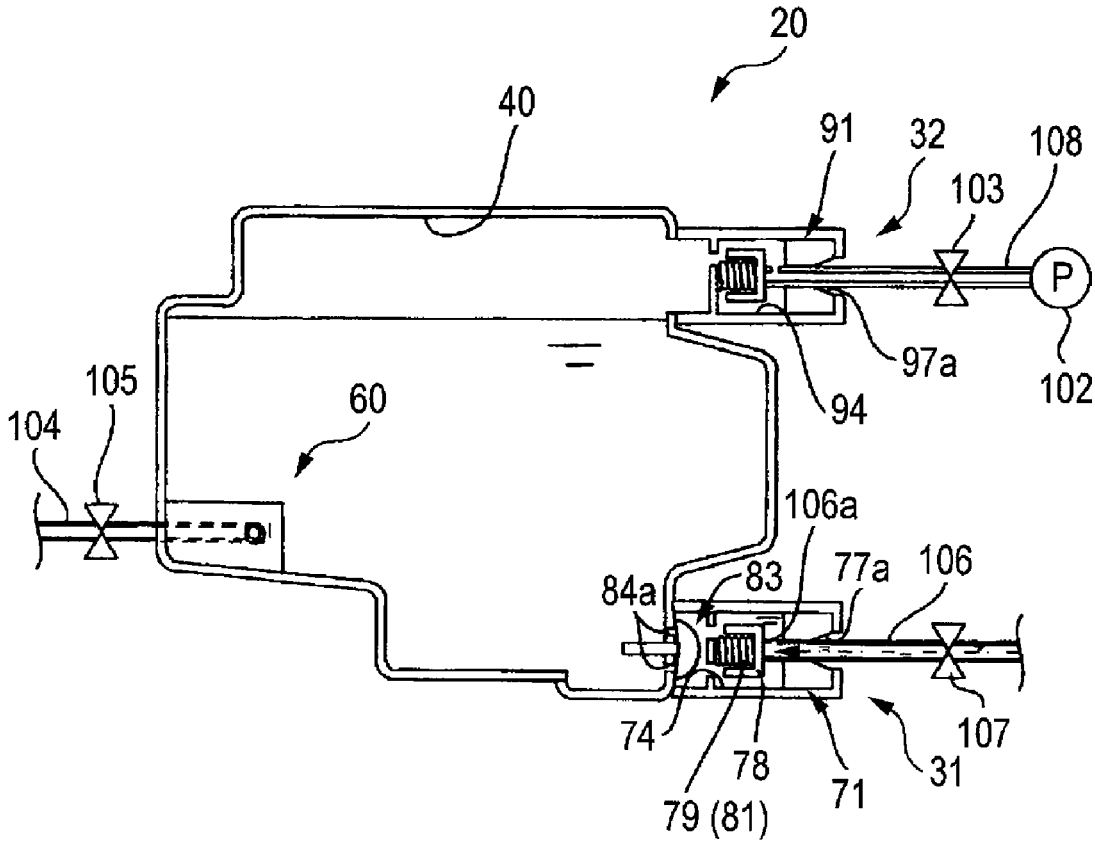
FIG. 11 is a schematic diagram showing the cartridge main body at a step of injecting ink into an ink supply portion in the ink filling method of FIG. 7.

Next, as is shown in FIG. 11, one end of an injection pipe 106 is inserted into the ink supply portion 31, and the one end of the injection pipe 106 is brought into contact with the supply valve 78 to push the supply valve 78 to the rear side away from the supply joint 77 against the urging forces of the first supply spring 79 and the second supply spring 81. Thereby, the through hole 77*a* is opened (an ink supply hole open step). An injection opening 106*a* is formed in the vicinity of the one end of the injection pipe 106, and the inside of the suction pipe 106 communicates with the first accommodation chamber 74 via the injection opening 106*a*.

A valve 107 is provided between the one end and the other end of the injection pipe 106. The valve 107 opens and closes to selectively allow and prevent the communication between the one end to the other end of the injection pipe 106. By opening the valve 107 to allow ink to flow in from the other end of the injection pipe 106, ink is injected into the first accommodation chamber 74 via the injection opening 106*a* as is indicated by an arrow followed by a chain double-dashed line. Accordingly, the pressure in the first accommodation chamber 74 becomes a pressure P3 which is larger than the pressure P2 in the ink storage chamber 40 and is smaller than the atmospheric pressure. Here, P3 is set as, for example, a pressure of such a value that the check valve 83 is caused to close the communication holes 84*a* to thereby close the communication hole 75 due to a pressure differential (P3−P2) between the ink storage chamber 40 and the first accommodation chamber 74. For example, the check valve 83 is configured so as to close the communication holes 84*a* to thereby close the communication hole 75 when the pressure in the first accommodation chamber 74 is higher than the pressure in the ink storage chamber 40 by about 10 kPa (kilo Pascal) or more. In this case, P3 is adjusted to a value which is larger than P2 by 10 kPa or more and is smaller than the atmospheric pressure. Accordingly, the communication holes 84*a* are closed such that the communication hole 75 is closed (S4; a supply chamber pressure increasing step).

Figure 12:
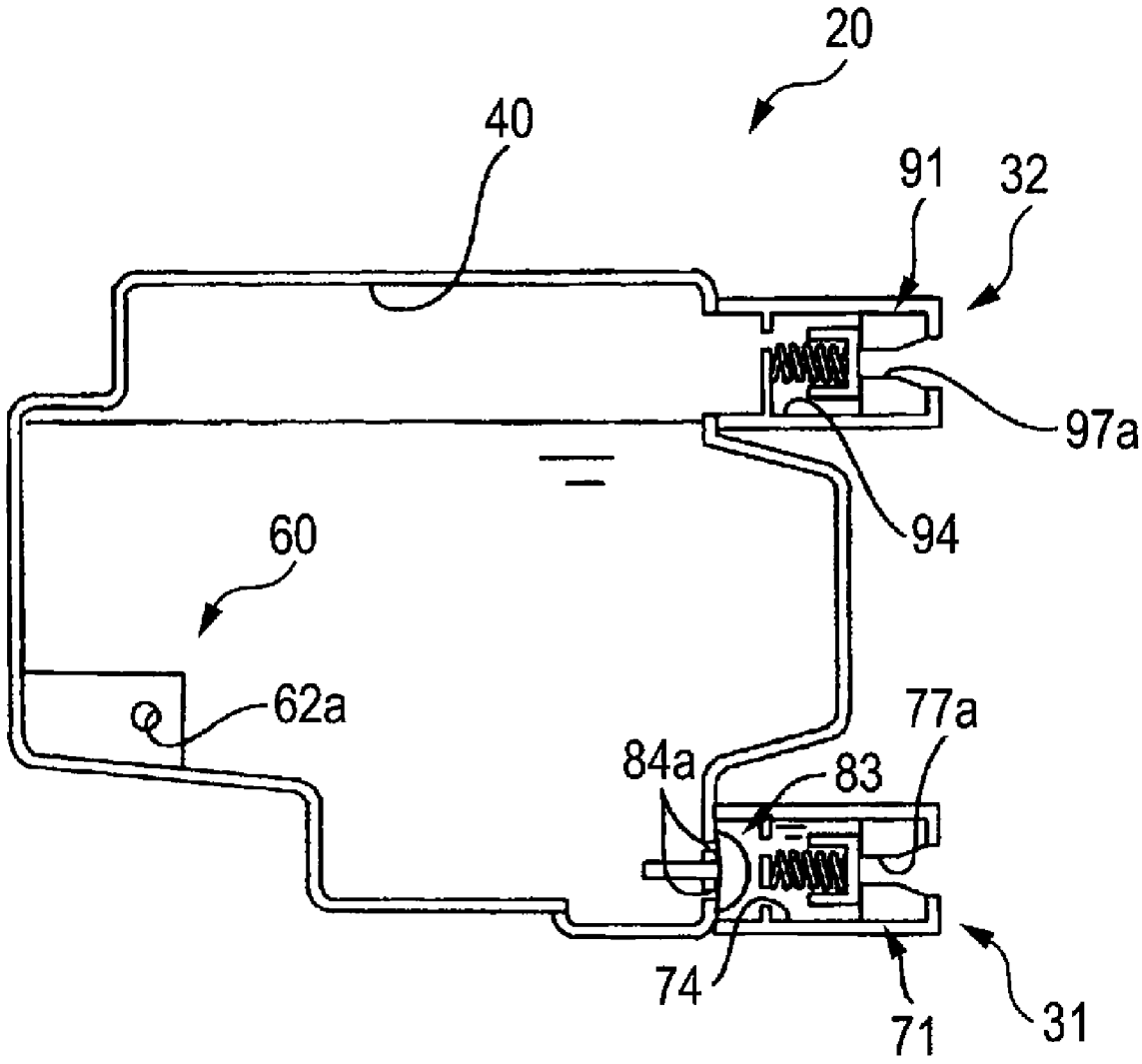
FIG. 12 is a schematic diagram showing the cartridge main body after all the steps have been completed in the ink filling method of FIG. 7.

The suction pipe 108 and the injection pipes 104 and 106 are then pulled out from the atmospheric introduction portion 32, the ink injection portion 60 and the ink supply portion 31, respectively. When this occurs, as shown in FIG. 12, ink is filled in the ink storage chamber 40, and the through holes 77*a* and 97*a* are closed by the first open/close mechanism 71 and the second open/close mechanism 91, respectively. In addition, as described above, the ink injection portion 60 is also sealed by the rubber plug 65.

When the cartridge main body 20 of the ink cartridge 4 which is filled with ink as described above is mounted to the inkjet printer 2, the ink extraction pipe 163 is inserted into the ink supply portion 31, and the atmospheric introduction portion 32 is opened.

Here, when the ink cartridge 4 is mounted, the check valve 83 closes the communication holes 84*a*, and the ink storage chamber 4 and the first accommodation chamber 74 are not in fluid communication. Consequently, when the ink extraction pipe 163 is inserted into the ink supply portion 31, the negative pressure in the ink storage chamber 40 does not propagate into the ink extraction pipe 163. Therefore, according to the embodiment, the collapse of menisci of ink in the nozzles 5*a* is prevented which would otherwise be the case due to the negative pressure in the ink storage chamber 40 being allowed to propagate to the nozzle 5*a* via the ink extraction pipe 163.

The pressure in the ink storage chamber 40 becomes substantially equal to the atmospheric pressure and the pressure in the first accommodation chamber 74 becomes substantially equal to or lower than the pressure in the ink storage chamber 40 when the atmospheric introduction portion 32 is opened. Accordingly, the check valve 83 opens the communication holes 84*a*. Therefore, the ink stored in the ink storage chamber 40 can be supplied to the inkjet printer 2 via the first accommodation chamber 74.

Before the ink cartridge 4 is mounted to the inkjet printer 2, the pressure in the first accommodation chamber 74 is maintained to be larger than the pressure in the ink storage chamber 40 and smaller than the atmospheric pressure. Accordingly, the negative pressure in the ink storage chamber 40 does not affect the ink in the nozzles 5*a* when the ink cartridge 4 is mounted, and also, the leakage of ink from the first accommodation chamber 74 before the mounting is suppressed.

The first accommodation chamber 74 is filled with ink before the ink cartridge 4 is mounted to the inkjet printer 2. Accordingly, the flow of air into the ink flow path of the inkjet printer 2 is suppressed when the ink cartridge 4 is mounted, compared with a case where the first accommodation chamber 74 is filled with air. When air flows into the ink flow path, a printing operation can be executed after the air in the ink flow path has been removed by the purge mechanism 11. However, according to the configuration described above, such an operation for removing extra air can be reduced.

The first open/close mechanism 71 is provided in this embodiment, the ink supply portion 31 is ensured to be sealed. As compared with a second embodiment (described later) where the ink supply portion 31 is sealed by means of a sealing tape, even after the ink cartridge 4 is removed from the inkjet printer 2, the ink supply portion 31 can be sealed again.

In the ink filling method of the embodiment, the ink storage chamber 40 is depressurized again after ink is injected from the ink injection portion 60. The pressure in the ink storage chamber 40 may increase when ink is injected from the ink injection portion 60. When the pressure in the ink storage chamber 40 increases, the pressure lower than the atmospheric pressure in the storage chamber 40 may not be kept to prevent the deterioration of ink quality, and also the check valve 83 may not be appropriately operate to close the communication holes 84*a*. However, by depressurizing the ink storage chamber 40 again as described above, the pressure in the ink storage chamber 40 can be secured to be lower than the atmospheric pressure, which enables the deterioration of ink quality to be suppressed, and the check valve 83 to appropriately close the through holes.

Second Embodiment

Hereinafter, a second embodiment will be described with reference to FIGS. 13A to 13E. An ink cartridge of the second embodiment differs from the ink cartridge 4 of the first embodiment in the configuration of an ink supply portion. In the following description, only the ink supply portion and the periphery thereof of the second embodiment will be described. In addition, the same reference numerals will be denoted to the same or similar elements of the second embodiment as or to those in the first embodiment.

Figure 13A:
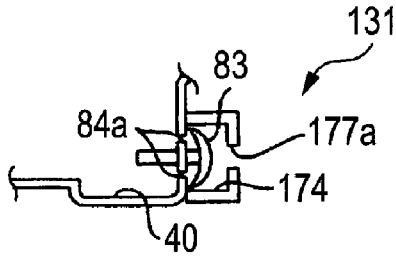
FIGS. 13A to 13E are schematic diagrams showing the ink supply portion of an ink cartridge according to a second embodiment of the invention, and showing an ink filling method according to the second embodiment.

FIG. 13A is a schematic diagram showing an ink supply portion 131 provided in an ink cartridge of the second embodiment. The ink cartridge of the second embodiment corresponds to the ink cartridge 4 of the first embodiment in which the ink supply portion 31 is replaced with the ink supply portion 131. The ink supply portion 131 differs from the ink supply portion 31 in that the ink supply portion 131 does not have the first open/close mechanism 71. The ink supply portion 131 has a third accommodation chamber 174 and a check valve 83. As with the first embodiment, the check valve 83 can close communication holes 84*a* depending on a pressure differential between the third accommodation chamber 174 and the ink storage chamber 40. The third accommodation chamber 174 is opened to the outside before the ink cartridge is filled with ink via a hole 177*a* (an ink supply hole) which is formed at an front end of the third accommodation chamber 174.

Figure 13B:
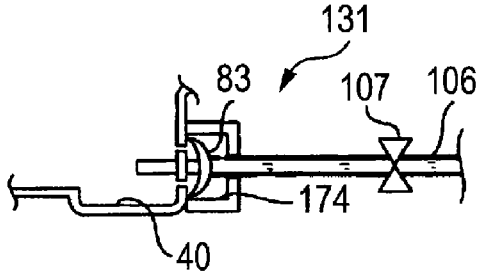

An ink filling method for filling the ink cartridge of the second embodiment with ink will be described with reference to FIGS. 13B to 13E. Firstly, as is shown in FIG. 13B, an injection pipe 106 is inserted into the third accommodation chamber 174 from the hole 177*a*. Then, a valve 107 is closed.

Figure 13C:
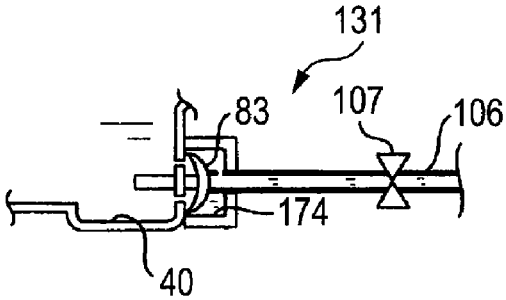

Next, the ink storage chamber 40 is depressurized via the atmospheric introduction portion 32 (a first depressurization step). Then, ink is injected into the ink storage chamber 40 via the ink injection portion 60 (an injection step). FIG. 13C shows the ink supply portion 131 and the periphery thereof after ink has been injected. Furthermore, the ink storage chamber 40 is depressurized via the atmospheric introduction portion 32 (a second depressurization step).

Figure 13D:
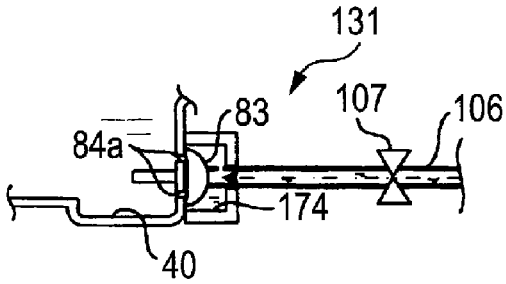
Figure 13E:
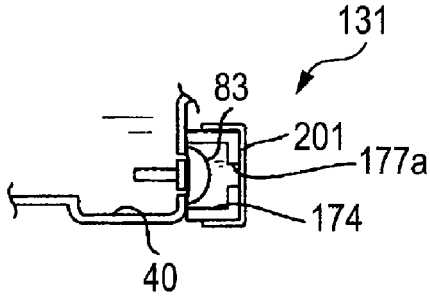

Next, the valve 107 is opened, and as is indicated by a chain double-dashed line in FIG. 13D, ink is injected into the third accommodation chamber 174 via the injection pipe 106. Accordingly, the pressure in the third accommodation chamber 174 becomes higher than the pressure in the ink storage chamber 40, and the check valve 83 closes the communication holes 84*a* (a supply chamber pressure increasing step). Here, the pressure in the third accommodation chamber 174 may be increased to the atmospheric pressure or may be increased to a value which is less than the atmospheric pressure.

Then, the injection pipe 106 is pulled out from the ink supply portion 131, and thereafter, a sealing tape 201 is adhered to an exterior surface of the ink supply portion 131 to cover the hole 177*a*. The leakage of ink from the third accommodation chamber 174 is prevented by the sealing tape 201. Note that although air can flow into the third accommodation chamber 174 via the hole 177*a* when the injection pipe 106 is pulled out, in this case, since either the pressure in the third accommodation chamber 174 is increased or maintained at a pressure equal to the atmospheric pressure, the check valve 83 continues to close the communication holes 84*a*.

Thus, also in the second embodiment, the check valve 83 closes the communication holes 84*a* when the ink cartridge is mounted to the inkjet printer 2, and the ink storage chamber 40 and the third accommodation chamber 174 are not in fluid communication. Consequently, when the ink extraction pipe 163 is inserted into the ink supply portion 131, the negative pressure in the ink storage chamber 40 does not propagate into the ink exertion pipe 163. Consequently, the collapse of menisci of ink in the nozzles 5*a* is prevented which would otherwise be the case due to the negative pressure in the ink storage chamber 40 being allowed to propagate to the nozzle 5*a* via the ink extraction pipe 163.

In addition, no open/close mechanism is provided in the ink supply portion 131. However, by inserting the injection pipe 106 into the hole 177*a* before ink is introduced into the ink storage chamber 40, the leakage of ink through the hole 177*a* when the ink is introduced into the ink storage chamber 40 is prevented.

Other Embodiments

While the embodiments of the invention have been described heretofore, the invention is not limited to the embodiments but can be modified variously without departing from the spirit and scope of the invention which are set forth in the description.

For example, in the ink filling methods of the embodiments, ink is injected into the first accommodation chamber 74 or the third accommodation chamber 174. However, these accommodation chambers may be filled with gas such as air. In addition, the pressure in the first accommodation chamber 74 or the third accommodation chamber 174 does not have to be lower than the atmospheric pressure but may be equal to the atmospheric pressure or may be larger than the atmospheric pressure.

The ink injection portion 60 may not be provided. In this case, ink can be injected, for example, via the atmospheric introduction portion 32.

In the ink filling method of the first embodiment, once the suction pipe 108 and the injection pipe 104 are inserted into the atmospheric introduction portion 32 and the ink injection portion 60, respectively, they are left inserted in the atmospheric introduction portion 32 and the ink injection portion 60, respectively, until all the steps are completed. However, the suction pipe 108 and the injection pipe 104 may be pulled out immediately after they have been used. Also, in this case, since the openings are closed by the second open/close mechanism 91 and the rubber plug 65, respectively, no steps of closing the openings are required, and hence, the subsequent steps can be executed quickly. Alternatively, the suction pipe 108 and the injection pipes 104 and 106 may all be inserted before step S1 of FIG. 7 and may be left inserted in the atmospheric introduction portion 32, the injection portion 60, and the ink supply portion 31, respectively, until all the steps are completed.

In the ink filling methods of the embodiments, the depressurizations of the ink storage chamber 40 are performed twice. However, such depressurization may only have to be performed once, when only one depressurization is enough, for example, when the pressure in the ink storage chamber 40 does not change so much even though ink is injected thereinto via the ink injection portion 60.

In the embodiments, while the ink injection portion 60 is configured so that the opening formed through the rubber plug 65 is closed by the elasticity of the rubber plug 65, the ink injection portion 60 may be closed by other means. For example, the ink injection portion 60 may be closed by filling the injection chamber 61 with a sealing member such as hardening adhesive after the injection pipe 104 has been pulled out from the injection chamber 61.

In the embodiments, while the invention is intended to be applied to the inkjet printer in which the inkjet head is mounted on the movable carriage, the invention may be applied to an inkjet printer having an inkjet head which is fixed to a printer casing.

What is claimed is:

1. An ink cartridge comprising:

an ink storage chamber configured to store ink therein;

an atmospheric communication portion configured to selectively allow fluid communication between the ink storage chamber and an outside of the ink cartridge; and an ink supply portion comprising:

an ink supply chamber configured to communicate with the ink storage chamber via a communication hole formed at a first end of the ink supply chamber, and configured to communicate with the outside of the ink cartridge via an ink supply hole formed at a second end of the ink supply chamber, such that ink stored in the ink storage chamber is supplied to the outside of the ink cartridge via the ink supply chamber;

a closing member configured to selectively open and close the ink supply hole; and a check valve configured to selectively open and close the communication hole depending on a pressure differential between a first pressure in the ink storage chamber and a second pressure in the ink supply chamber, wherein, when the ink storage chamber is filled with ink, and the ink supply hole and the atmospheric communication portion are closed, the first pressure is lower than an atmospheric pressure, and the second pressure is higher than the first pressure such that the check valve closes the communication hole.

2. The ink cartridge according to claim 1, wherein the second pressure is lower than the atmospheric pressure.

3. The ink cartridge according to claim 1, wherein the ink supply chamber is filled with ink under the second pressure.

4. The ink cartridge according to claim 1, wherein the closing member comprises:

a valve body provided in the ink supply chamber and configured to move between a close position to close the ink supply hole and an open position to open the ink supply hole; and an urging member configured to urge the valve body towards the close position.

5. The ink cartridge according to claim 1, wherein the check valve closes the communication hole when the pressure differential of the second pressure minus the first pressure is equal to or greater than a predetermined value.

6. An ink filling method for an ink cartridge, the ink cartridge comprising: an ink storage chamber configured to store ink therein; at least one atmospheric communication portion configured to selectively allow fluid communication between the ink storage chamber and an outside of the ink cartridge; and an ink supply portion comprising: an ink supply chamber configured to communicate with the ink storage chamber via a communication hole formed at a first end of the ink supply chamber, and configured to communicate with the outside of the ink cartridge via an ink supply hole formed at a second end of the ink supply chamber, such that ink stored in the ink storage chamber is supplied to the outside of the ink cartridge via the ink supply chamber; a closing member configured to selectively open and close the ink supply hole; and a check valve configured to selectively open and close the communication hole depending on a pressure differential between a first pressure in the ink storage chamber and a second pressure in the ink supply chamber, said ink filling method for the ink cartridge comprising:

discharging air in the ink storage chamber from the at least one atmospheric communication portion to make the first pressure to be lower than an atmospheric pressure;

after said discharging air, injecting ink from the at least one atmospheric communication portion into the ink storage chamber and the ink supply chamber; and after said injecting ink, increasing the second pressure to be higher than the first pressure such that the check valve closes the communication hole.

7. The ink filling method according to claim 6, wherein, in said increasing the second pressure, the second pressure is increased to a pressure lower than the atmospheric pressure.

8. The ink filling method according to claim 6, further comprising:

after said injecting the ink, additionally discharging air in the ink storage chamber from the at least one atmospheric communication portion to depressurize the ink storage chamber.

9. The ink filling method according to claim 6, wherein the closing member comprises: a valve body provided in the ink supply chamber and configured to move between a close position where the closing member closes the ink supply hole and an open position where the closing member is positioned apart from the ink supply hole; and an urging member configured to urge the valve body towards the close position such that the valve body is positioned in the close position at said discharging air and said injecting ink, and wherein said increasing the second pressure comprises:

moving the valve body to the open position by pushing the valve body in an opposite direction to a direction in which the valve body is urged by the urging member; and increasing the second pressure higher than the first pressure via the ink supply hole which has been opened.

10. The ink filling method according to claim 6, wherein the at least one atmospheric communication portion comprises a first atmospheric communication portion and a second atmospheric communication portion, wherein said discharging the air is performed through the first atmospheric communication portion, and wherein said injecting the ink is performed through the second atmospheric communication portion.

* * * * *